US007073347B2

(12) United States Patent
Hermes et al.

(10) Patent No.: US 7,073,347 B2
(45) Date of Patent: Jul. 11, 2006

(54) EVAPORATOR FOR A REFRIGERATION SYSTEM

(75) Inventors: Christian Johann Losso Hermes, Joinville (BR); Marco Eduardo Marques, Joinville (BR)

(73) Assignee: Multibras S.A. Eletrodomesticos, Sao Paulo-SP (BR)

( * ) Notice: Subject to any disclaimer, the term of this patent is extended or adjusted under 35 U.S.C. 154(b) by 0 days.

(21) Appl. No.: 10/522,633

(22) PCT Filed: Aug. 13, 2003

(86) PCT No.: PCT/BR03/00113

§ 371 (c)(1),
(2), (4) Date: Mar. 16, 2005

(87) PCT Pub. No.: WO2004/016996

PCT Pub. Date: Feb. 26, 2004

(65) Prior Publication Data

US 2005/0247077 A1 Nov. 10, 2005

(30) Foreign Application Priority Data

Aug. 14, 2002 (BR) ..... 0203675

(51) Int. Cl.
*F25B 39/02* (2006.01)

(52) U.S. Cl. ..... 62/515

(58) Field of Classification Search ..... 62/515, 62/441; 165/146

See application file for complete search history.

(56) References Cited

U.S. PATENT DOCUMENTS 3,267,692 A * 8/1966 Pfeiffer et al. ..... 62/515
4,545,428 A * 10/1985 Onishi et al. ..... 165/110
5,157,941 A 10/1992 Cur et al.
6,272,876 B1 8/2001 Roberts et al.

OTHER PUBLICATIONS

Patent Abstracts of Japan; vol. 1998, No. 8, Jun. 30, 1998, & JP 10 073395 A (Samsung Electron Co Ltd), Mar. 17, 1998.
Patent Abstracts of Japan; vol. 2000, No. 11, Jan. 3, 2001 & JP 2000 234884 A (Kimura Kohki Co Ltd), Aug. 29, 2000.
Patent Abstracts of Japan; vol. 2000, No. 12, Jan. 3, 2001 & JP 2000 241045 A (Yanmar Diesel Engine Co Ltd), Sep. 8, 2000.

(Continued)

*Primary Examiner*—Melvin Jones
(74) *Attorney, Agent, or Firm*—Darby & Darby

(57) ABSTRACT

An evaporator for a refrigeration system, comprising a tube provided with fins and mounted in the form of a coil, conducting a refrigerating fluid therewithin and comprising tube portions (20*a*) arranged parallel to each other and which are transversal to the direction of a forced airflow (F) that passes externally through the evaporator (10), from a first end region (11) of air ad to a second end region (12) of air outlet of the evaporator (10). The tube portions (20*a*) are arranged in the form of at l (S), having an inlet end (21) provided in the second end region (12) of the evaporator (10) and an outlet end (22) prov first end region (11) of the evaporator (10), so that the refrigerating fluid flows through the coil (S) in counterflow in relation forced airflow (F).

2 Claims, 4 Drawing Sheets

OTHER PUBLICATIONS

Patent Abstracts of Japan; vol. 2000, No. 25, Apr. 12, 2001 & JP 2001 227842 A (Sanyo Electric Co Ltd), Aug. 24, 2001.

Patent Abstracts of Japan; vol. 2002, No. 7, Jul. 3, 2002, & JP 2002 081839 A (Matsushita Refrig Co Ltd), Mar. 22, 2002.

* cited by examiner

EVAPORATOR FOR A REFRIGERATION SYSTEM

CROSS REFERENCE TO PRIOR APPLICATION

This is a U.S. national phase application under 35 U.S.C. §371 of International Patent Application No. PCT/BR2003/000113, filed Aug. 13, 2003, and claims benefit of Brazilian Patent Application No. PI 0203675-4, filed Aug. 14, 2002 which is incorporated by reference herein. The International Application was published in English on Feb. 26, 2004 as WO 2004/016996 A1 under PCT Article 21(2).

FIELD OF THE INVENTION

The present invention refers to an evaporator for a refrigeration system with forced ventilation generally used in refrigerators, freezers, and other refrigeration appliances. The invention is particularly directed to an evaporator comprising an assembly of tubes arranged in series and incorporating thermal exchange extended surfaces, known as fins and over which passes a forced airflow to be refrigerated by evaporation of a refrigerating fluid supplied to the interior of the coil of the evaporator.

BACKGROUND OF THE INVENTION

Refrigeration systems with forced ventilation, which are usually applied in refrigerators and freezers, generally use an evaporator of the compact tube-fin type, comprising a plurality of fins that are incorporated and trespassed by a bundle of tubes arranged in series in the form of a coil, inside which flows a refrigerating fluid. Externally to the tubes and to the fins of the evaporator passes a forced airflow, which is removed from the inside of an environment to be refrigerated so as to be refrigerated by the evaporator and discharged back to the inside of said environment, as it occurs in the refrigerating or freezing compartments of a refrigeration appliance, for example.

These evaporators are constructed so as to assure a determined heat exchange rate between the forced airflow passing through the tubes of the evaporator and through the fins externally affixed to the tubes.

The evaporators of the tube-fin type with forced ventilation are normally used in household refrigerators and freezers of the no-frost or frost-free types with automatic defrost, usually comprising two vertical and parallel rows of horizontal tubes 20, which are incorporated to fins 30 and connected in series in each row, defining two mutually parallel vertical coils connected in series to each other, as shown in FIGS. 1, 2, and 3 of the enclosed drawings. In these evaporators, the refrigerating fluid, which is refrigerated in the condenser of the refrigeration system and expanded through an expanding device, is supplied to a tube 20 of a first vertical coil S1 located in the region 12 for the outlet of the forced airflow F that passes through the evaporator 10. The refrigerating fluid flows through the first coil S1, generally from top to bottom and in an opposite direction or in counterflow in relation to the forced airflow F.

The refrigerating fluid is conducted to a second coil S2, flowing through the latter in an opposite direction to the flow in the first coil S1, that is, in the same direction of the forced airflow, defining a parallel or concurrent flow heat exchanger.

The prior art constructive arrangement utilizes two parallel coils (S1, S2) connected in series and conducting the refrigerating fluid in opposite directions, that is, defining, respectively, a counterflow heat exchanger followed by a heat exchanger with a flow that is parallel to the forced airflow passing through the evaporator.

In the constructions of this type, in which it is possible to occur a significant overheating of the refrigerating fluid in the region close to the outlet of the evaporator, which situation generally occurs during the transient working period, the first coil S1, which operates as a counterflow heat exchanger, presents a higher efficiency than the second coil S2 operating as a parallel flow heat exchanger.

Considering that the operation of the household refrigerators and freezers is controlled by a thermostat, the behavior thereof is typically transient, making the tubes 20 of the evaporator 10 contain overheated vapor during most of its working period.

If there were no overheating of the vaporized refrigerant at the outlet of the evaporator, the second coil S2 in concurrent flow in relation to the forced airflow F would present a performance equivalent to the first coil S1 operating in counterflow.

However, the condition without overheating is observed only when the refrigeration system is working in a permanent regimen, which does not occur in practice.

The fact of existing a region with overheated vapor in the evaporator 10 of a refrigerator or a freezer with forced ventilation during most of the working time of these household appliances indicates that the performance of the first coil S1 in counterflow is better than that of the second coil S2, in which the flow of the refrigerating fluid is parallel to the forced airflow and in which the overheating region generally appears (outlet region).

OBJECTS OF THE INVENTION

As a function of the operational problem mentioned above, it is the object of the present invention to provide an evaporator for a refrigeration system of the forced ventilation type, to be used in refrigerators and freezers, which presents a higher global coefficient of heat transfer, so that the appliance can operate with a higher evaporation pressure, which increases the energetic efficiency of the refrigeration system.

SUMMARY OF THE INVENTION

The evaporator of the present invention comprises a tube provided with fins and bent in the form of a coil, conducting a refrigerating fluid therewithin and comprising tube portions, disposed parallel to each other and which are transversal to the direction of a forced airflow that passes externally through the evaporator, from a first end region of air admission to a second end region of air outlet of said evaporator.

According to the invention, the tube has its tube portions arranged as a coil, having an inlet end provided in the second end region of the evaporator, and an outlet end provided in the first end region of the evaporator, so that the refrigerating fluid flows through the coil in counterflow in relation to the forced airflow.

The constructive arrangement proposed by the invention and described above allows the overheated refrigerating fluid to be found in the first end region of the evaporator, forming a counterflow heat exchanger.

BRIEF DESCRIPTION OF THE DRAWINGS

The invention will be described below, with reference to the enclosed drawings, given as a way of example for a preferred embodiment, and in which.

DETAILED DESCRIPTION OF THE INVENTION

Figure 1:
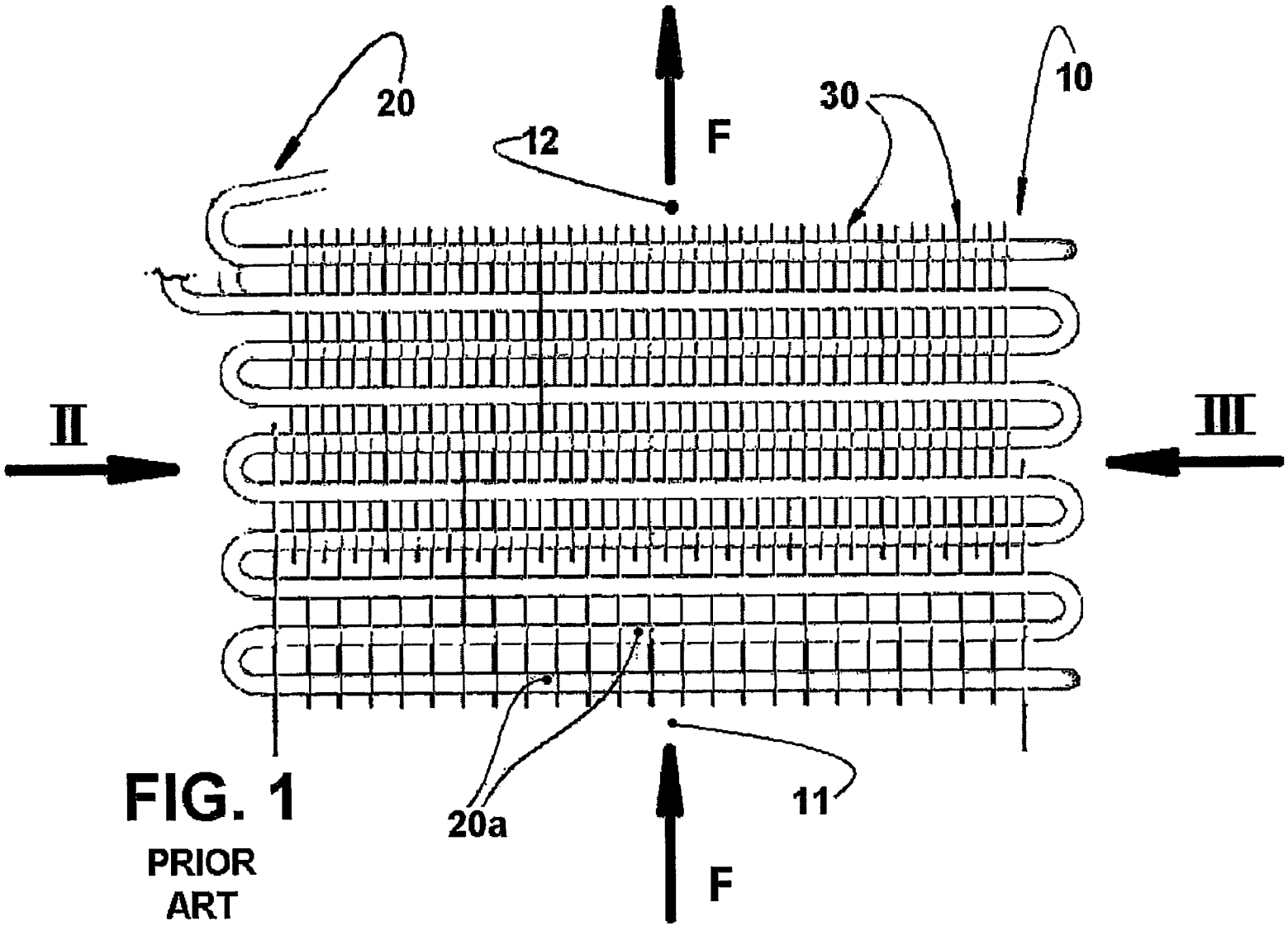
FIG. 1 PRIOR ART
FIG. 1 is a simplified front view of a prior art evaporator of the tube-fin type, comprising two parallel coils.
Figure 2:
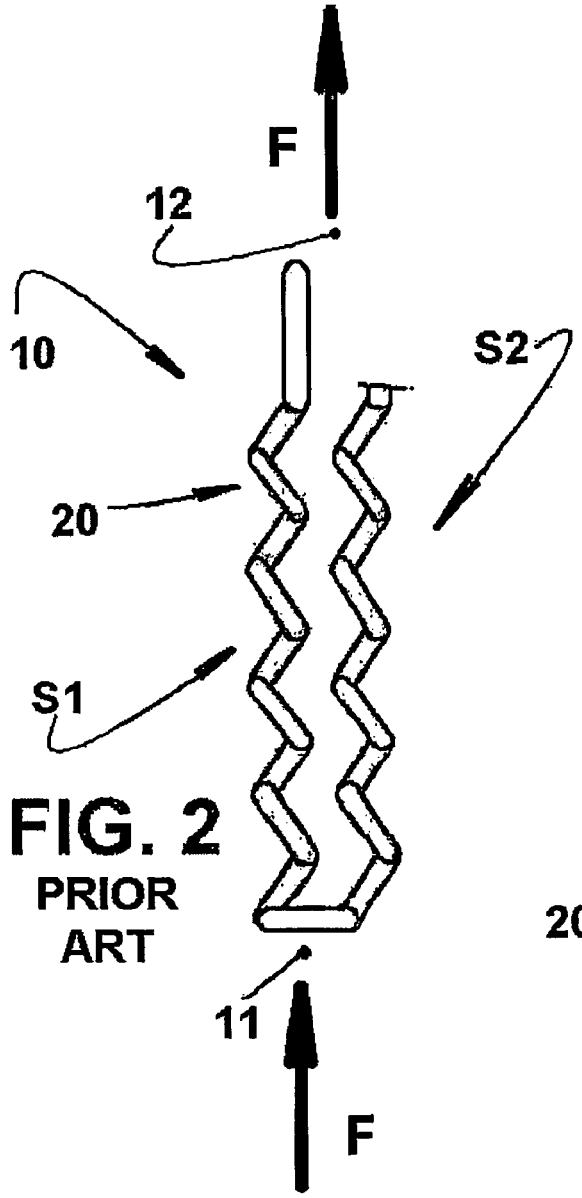
FIG. 2 PRIOR ART
FIGS. 2 and 3 are opposite end views of the prior art evaporator, taken according to the arrows II and III of FIG. 1, respectively.
Figure 3:
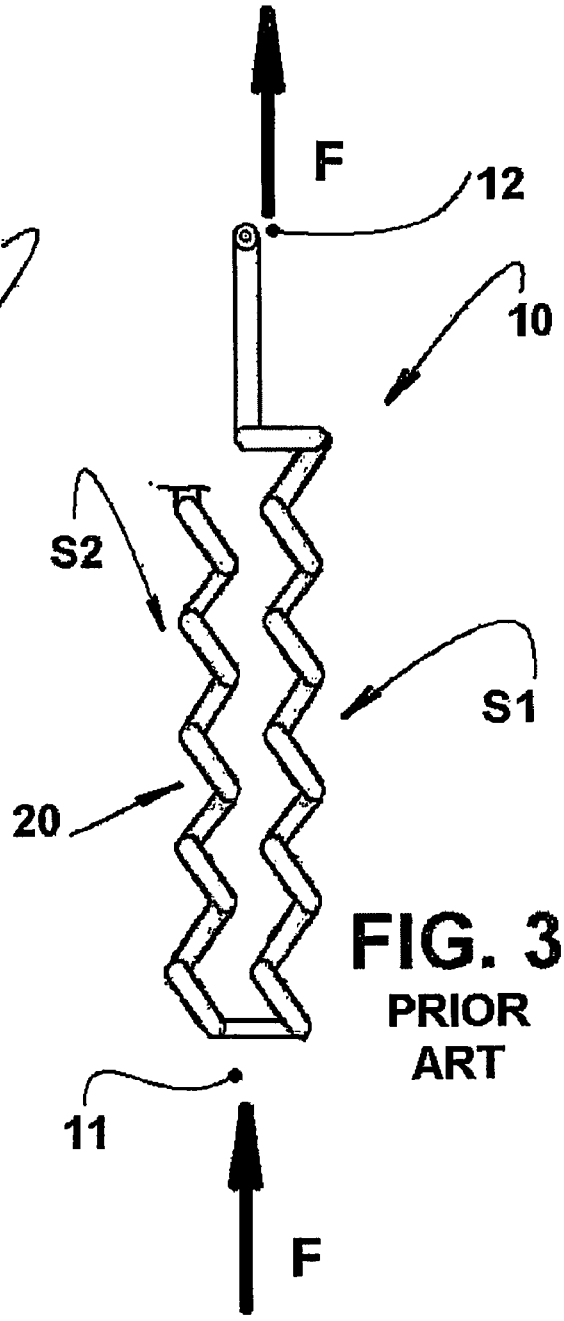
FIG. 3 PRIOR ART
Figure 4:
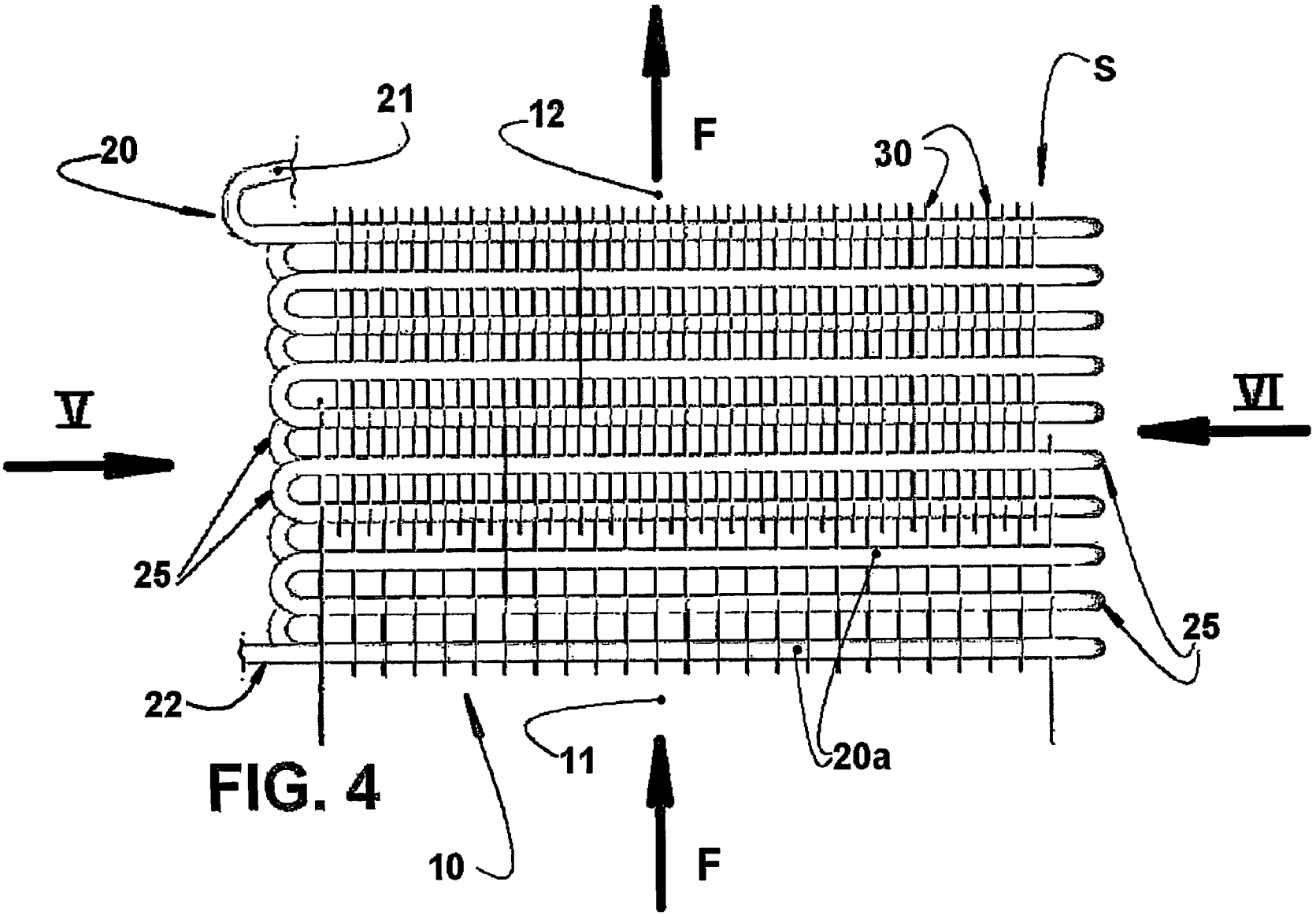
FIG. 4 is a simplified front view of an evaporator constructed according to the present invention.
Figure 5:
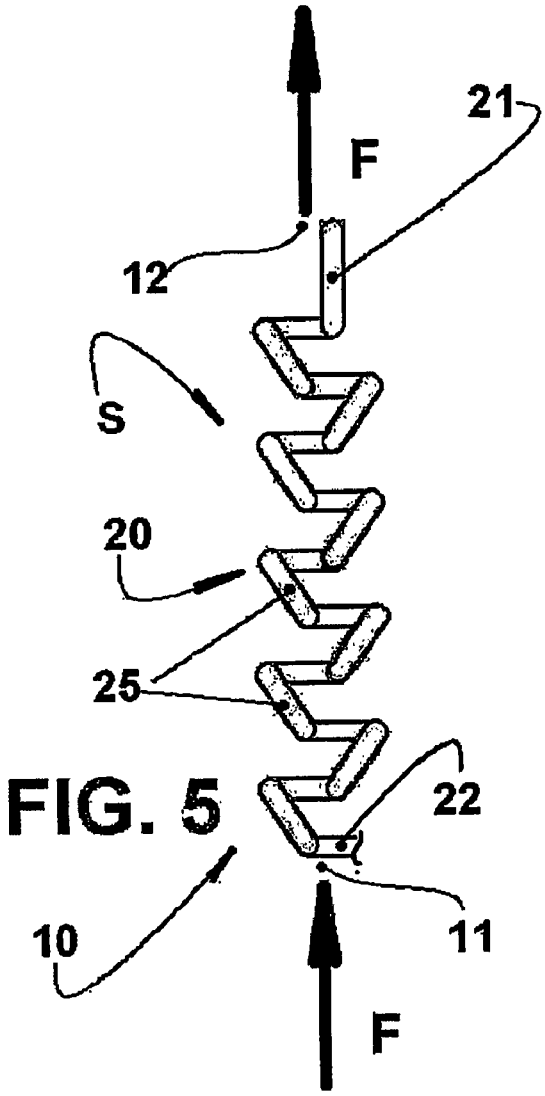
FIG. 5 is a lateral view of the present evaporator, taken according to the arrow V of FIG. 4.
Figure 6:
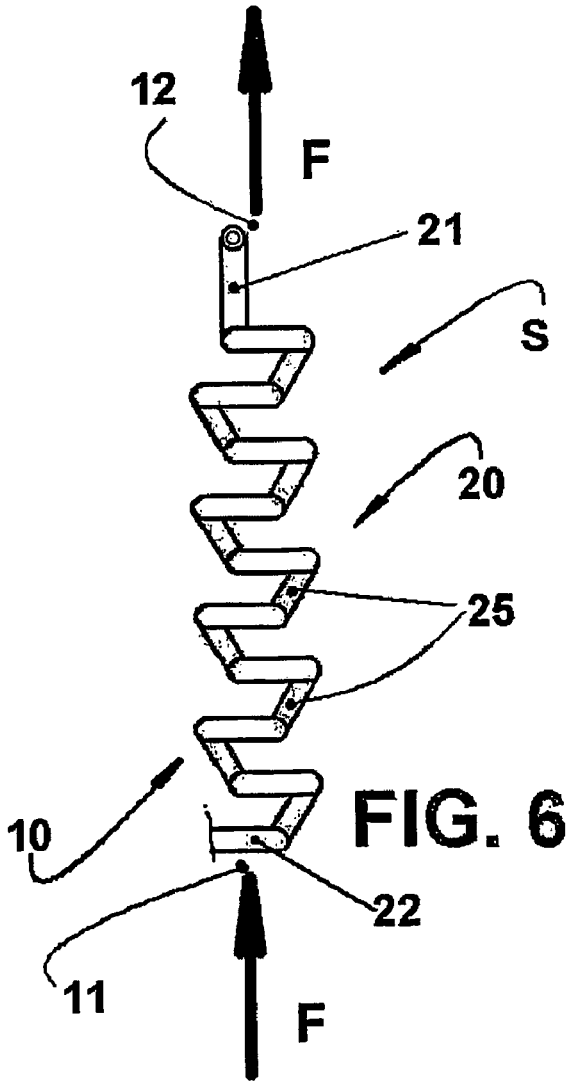
FIG. 6 is an opposite lateral view of the evaporator of the invention, taken according to the arrow VI of FIG. 4.

As illustrated in FIGS. 4, 5, and 6, the evaporator 10 of the present invention comprises a tube 20 bent in the form of a coil and which incorporates fins 30 to increase its heat exchange capacity in the external region, said tube 20 being known as a finned tube.

The tube 20 comprises several tube portions 20*a* in a single piece or in distinct pieces, which are connected in series to each other so as to conduct a refrigerating fluid of the refrigeration system with which the evaporator 10 is operatively associated. The tube portions 20*a* are arranged in such a way as to form a bundle of tubes parallel to each other and transversal to the direction of a forced airflow F that passes externally through the evaporator 10.

The forced airflow F is generally produced by suction or discharge of a fan (not illustrated), in such a way as to enter into the evaporator 10 through a first end region 11 of air admission, and to leave the evaporator 10 through a second end region 12.

The tube 20 comprising the tube portions 20*a* and the fins 30 are obtained from any adequate metallic material with high thermal conductivity, with the fins being generally rectilinear and parallel to the displacement direction of the forced airflow F.

According to the illustrated embodiment of the invention, the tube 20 comprising the tube portions 20*a* is arranged in a single coil S, having an inlet end 21, for admission of the refrigerating fluid into the evaporator 10, which is located in the second end region 12 of the evaporator 10 in which the already refrigerated forced airflow F is delivered. The coil S further presents an outlet end 22 provided in the first end region 11 of the evaporator 10 and through which the hot air is admitted, so that the refrigerating fluid flows through the coil S in counterflow in relation to the forced airflow F.

In the illustrated construction, only one coil S is used. However, the hypothesis of providing two or more coils in a parallel arrangement should be considered, each defining a heat exchanger in counterflow in relation to the forced airflow F.

In the illustrated construction, the coil S is formed by several mutually parallel rows of tube portions 20*a*, which are connected in series at the opposite ends thereof by respective curved parts 25, the rows preferably lying on planes that are parallel to each other and transversal to the forced airflow F.

With the proposed construction, the refrigerating fluid flows in a direction opposite to that of the forced airflow F, forming a counterflow heat exchanger, maintaining a more uniform temperature difference between the refrigerating fluid and the forced airflow throughout the whole extension of the evaporator, thus obtaining a better performance from the heat exchanger.

The invention claimed is:

1. An evaporator for a refrigeration system, comprising a tube provided with fins and bent in the form of a coil, the coil conducting a refrigerating fluid therewithin and comprising tube portions arranged in parallel rows that each define a plane which is substantially perpendicular to the direction of a forced airflow that passes externally through the evaporator, from a first end region of air admission to a second end regions of air outlet of the evaporator, characterized in that the tube has its tube portions arranged as a coil, having an inlet end provided in the second end region of the evaporator and an outlet end provided in the first end region of the evaporator, so that the refrigerating fluid flows through the coil in counterflow in relation to the forced airflow.

2. An evaporator according to claim 1, characterized in that the parallel rows of tube portions are connected in series at the opposite ends thereof, and paired tube portions defining each of the parallel rows are alternatingly staggered along their respective planes.

* * * * *